United States Patent [19]

Huber

[11] Patent Number: 4,600,407

[45] Date of Patent: Jul. 15, 1986

[54] PROCESS FOR THE PRODUCTION OF SWELLABLE FILAMENTS, FIBERS AND SHAPED STRUCTURES OF ACRYLIC POLYMERS, AND THE PRODUCTS OBTAINED THEREBY

[75] Inventor: Bernd Huber, Wiesbaden, Fed. Rep. of Germany

[73] Assignee: Hoechst Aktiengesellschaft, Frankfurt am Main, Fed. Rep. of Germany

8

[21] Appl. No.: 750,046

[22] Filed: Jun. 27, 1985

[30] Foreign Application Priority Data

Sep. 13, 1980 [DE] Fed. Rep. of Germany ..... 3034660

[51] Int. Cl.[4] ..... D01F 6/18; D02G 3/02; D04B 1/14

[52] U.S. Cl. ..... 8/115.54; 264/182; 428/364

[58] Field of Search ..... 8/115.54, 115.68, 115.69, 8/115.59, 115.65

[56] References Cited

U.S. PATENT DOCUMENTS 4,143,200 3/1979 Radlmann et al. ..... 428/373
4,337,328 6/1982 Holst ..... 525/329.2

FOREIGN PATENT DOCUMENTS 49-007526 1/1974 Japan .
50-075265 6/1975 Japan .
53-123453 10/1978 Japan .

*Primary Examiner*— Clingman
*Attorney, Agent, or Firm*—Curtis, Morris & Safford

[57] ABSTRACT

The invention relates to a process for the production of swellable filaments, fibers and shaped structures of acrylic polymer, by reacting the free carboxyl groups of the filament-forming substance with substances which react in a basic manner, with water being excluded, and to swellable filaments and fibers thus obtained, which, in the dry state, have tensile strengths of more than 10 cN/tex and knot strengths of more than 6 cN/tex and which can be further processed by means of the customary textile machinery.

8 Claims, No Drawings

PROCESS FOR THE PRODUCTION OF SWELLABLE FILAMENTS, FIBERS AND SHAPED STRUCTURES OF ACRYLIC POLYMERS, AND THE PRODUCTS OBTAINED THEREBY

This is a continuation of application Ser. No. 548,021 filed Nov. 2, 1983 and now abandoned, which in turn is a continuation of Ser. No. 301,411 filed Sept. 11, 1981 and now abandoned.

The invention relates to filaments or fibers and a process for the production of said filaments or fibers and structures which have been formed therefrom. The filaments or fibers are composed of acrylic polymers, the filament-forming substance of which is composed of acrylonitrile and of monomer units, which can be copolymerized with acrylonitrile, and have carboxyl groups which have been at least partially converted into the salt form.

Fibers composed of acrylic polymers, which contain salts of carboxyl groups, are known. Thus, for example, German Offenlegungsschrift No. 2,434,232 describes a process for the production of acrylic fibers with improved hygroscopicity, in which raw materials, which contain carboxyl groups, are spun into fibers, the fibers are subsequently crosslinked and the carboxyl groups are converted into the salt form in an aqueous alkaline medium. In the examples, polymers with up to 12% of acrylic acid (corresponding to 7.5% by weight of COOH groups) or 15% of methacrylic acid (corresponding to 7.8% by weight of COOH groups) are used. The resulting fibers exhibit good textile-technological properties, but due to the crosslinking carried out they are only very slightly swellable, if at all.

German Offenlegungsschrift No. 2,358,853 describes a process for the production of fibers of high water swellability wherein the spun fibers are cross-linked with hydroxylamine and are subsequently saponified in an aqueous alkaline medium. The fibers thus produced are obtained in a highly swollen state. If these highly swollen fibers or filaments are dried, the fiber material obtained is very brittle and, in part, sticks together extensively, and cannot be further processed into textile structures, such as, for example, yarns, knitted fabrics or woven fabrics, in the customary manner.

An alkaline hydrolysis can also be carried out in alkaline aqueous organic solvents, such as, for example, glycol or glycerol. The products obtained in this way are also brittle in the dry state and present problems for further textile processing (German Offenlegungsschrift No. 2,903,267).

German Offenlegungsschrift No. 2,942,064 describes swellable acrylic fibers having a sheath/core structure, in which the sheath is composed of a hydrophilic crosslinked polymer, which contains carboxyl groups, and the core is composed of a normal acrylonitrile polymer and/or another polymer. The process described in which the sheath layer is generated by alkaline hydrolysis in an aqueous medium is very costly since the fibers are obtained in a highly swollen state and have to be dried requiring a large amount of energy. In addition, there is also always the great danger that, despite the crosslinking carried out, the fibers will stick extensively to one another on drying.

Therefore, a need exists for a process to prepare highly absorbent acrylic filaments and fibers, which could be processed into waddings, yarns, nonwovens and other textile structures while overcoming the problem attendant to the methods known in the textile industry. In order to guarantee problem-free processing, such filaments and fibers had to have at least the textile-technological properties of wool, for example with respect to tensile strength and knot strength.

It has now been found, surprisingly, that filaments and fibers of acrylic polymers, which have free carboxyl groups, can be converted into the salt form in a non-aqueous medium. Acrylic polymers, whose carboxyl groups have been converted into the salt form, have outstanding swellability in water, in contrast to polymers with free carboxyl groups.

Particularly suitable filaments and fibers are those in which the filament-forming substance is composed of an acrylic polymer which contains, as well as acrylonitrile units and other units which can be copolymerized with acrylonitrile, 10 to 30% by weight of carboxyl groups. Such filaments and fibers of acrylic polymers, which contain carboxyl groups, can be obtained by spinning a polymeric raw material according to the usual spinning processes for acrylic filaments and fibers, the polymeric raw material being composed of an acrylonitrile polymer or copolymer, which has been partly hydrolyzed in a heterogeneous phase system using dilute aqueous acids. A dilute aqueous sulfuric acid of 40 to 50% strength by weight is particularly suitable for the hydrolysis. Filaments and fibers of this type, composed of acrylic polymers containing carboxyl groups, their use and a process for their production are the subject of a co-pending application filed on the same date.

In accordance with the present invention during the conversion of the free carboxyl groups into the salt form in the absence of water swelling of the filaments and fibers during the salt formation is avoided. The original structure, and thus also the good textile-technological properties, are largely retained also for those filaments and fibers, in which the carboxyl groups exist in the salt form. A particular advantage of the process according to the invention is the result of the discovery that by using the same fibers as starting materials, the swelling capacity of the converted filaments and fibers can be varied over a wide range by changing the amount of base used for the reaction.

The process according to the invention can also be applied to already formed structures such as, for example, waddings, nonwovens, yarns and other textile sheet structures, which contain fibers containing carboxyl groups. Here too, the swelling capacity can be set exactly by the amount of base employed.

On the other hand, it is also possible to process those filaments and fibers which have already been converted into the salt form, into shaped structures with excellent swelling capacity, as they have remained largely unchanged in their textile-technological properties, due to the exclusion of water during the salt formation.

The reaction of fibers and filaments, having free carboxyl groups, with gaseous bases suggests itself as an advantageous process for the conversion of the free carboxyl groups into the salt form. Ammonia, hydrazine and vaporizable organic nitrogen compounds, which react in a basic manner, are above all suitable for use as bases. Particularly preferred compounds for this use are those which are vaporizable at temperatures below 200° C., if appropriate under reduced pressure.

Thus, for example, monomethylamine, dimethylamine, trimethylamine, the corresponding ethylamines, propylamines, butylamines, pentylamines and hexylamines, and also the corresponding mixed compounds such as methylethylamine or methylbutylamine, can be used. Amines which additionally contain other functional groups, such as, for example, 2-hydroxyethylamine, or other compounds, where the other functional group can again be an amine, such as, for example, 1,2-diaminoethane, are also suitable. Cyclic, saturated or unsaturated nitrogen compounds such as, for example, pyrrolidine, pyrroline, pyrrole, pyridine and their derivatives can also be used. Apart from amines, other basic organic compounds can be used, such as, for example, hydrazines.

Alternatively to salt formation in the gas phase, fibers and filaments which contain carboxyl groups can also be converted in an anhydrous liquid phase system using liquid bases or solutions thereof in anhydrous organic solvents. In anhydrous organic solvents, basic compounds which are not easily volatilized can also be used, such as, for example, sodium hydroxide or potassium hydroxide in alcoholic solutions or alcoholates dissolved in alcohols.

The filaments and fibers according to the invention are particularly suitable for hygienic uses such as in the production of diapers or tampons, as admixture fiber in fiber nonwovens and filament nonwovens such as, for example, for use as inner shoe-lining, for air-permeable but waterproof woven fabrics, as a filter material, as an artificial nutrient soil for plant cultures, as a water-holding medium for garden soils, as tracer filaments or spacer filaments in telecommunication cables in order to confine any possible intrusion of water, and for use, for example as a mixture with other synthetic fibers or filaments, in the production of artificial leather.

In exceptional cases it can be advantageous to cross-link the fiber materials slightly, for example when they are used in hot strongly alkaline media, in order to lower the solubility which would otherwise be exhibited under these conditions.

Filaments produced according to the invention, where the carboxyl groups exist at least partially in the salt form, still show proper textile-technological values, as has already been mentioned above. They can therefore be processed into shaped structures such as yarns, nonwovens, fiber rovings, waddings, textile sheet structures and the like, provided care is taken that they do not come into contact with relatively large amounts of water.

Swellable filaments and fibers, according to the invention, the filament-forming substance of which is composed of an acrylic polymer containing up to 30% by weight of carboxyl groups, at least some of which have been converted into the salt form, as well as acrylonitrile units and units which can be copolymerized with acrylonitrile, are distinguished by having a tensile strength of more than 10 cN/tex and knot strengths of more than 6 cN/tex. They can be processed by means of the customary textile processes into waddings, yarns and sheet structures, since their textile-technological values correspond to at least those of wool. The swellability or water retention can vary within wide limits according to the degree of salt formation that has been carried out. With a low content of carboxyl groups and/or low salt formation, the water retention can be adjusted to values of, for example, 50 to 200%. With a larger number of carboxyl groups and/or an increased conversion into the salt form, the values of the water retention can be set at between a few hundred to a few thousand percent.

In a preferred embodiment, the swellable filaments and fibers according to the invention have in their filament-forming substance about 10 to 30% by weight of carboxyl groups which have at least partially been converted into the salt form.

The following examples are intended to illustrate the invention further. Unless otherwise indicated, the data in percentages and parts refer to amounts by weight.

EXAMPLE 1 TO 4

Pulverulent acrylic polymers composed of 93.7% of acrylonitrile, 5.8% of methyl acrylate and 0.5% of sodium methallylsulfonate were heterogeneously hydrolyzed using 46.2 to 48.2% strength sulfuric acids. In each case hydrolysis was carried out for 2.5 hours at the boil under reflux. After the reaction solution had cooled down, the polymer was filtered off, washed with water until free of sulfate, and subsequently dried. The resulting partially hydrolyzed acrylic polymers were then dissolved in dimethylformamide (DMF) to form spinning solutions and were then spun into filaments by spinning processes known from the case of polyacrylonitrile. Using customary methods, the filaments were washed, stretched, finished, dried, drawn, crimped and then cut into staple fibers of 40 mm staple length.

The resulting fibers exhibited the following properties:

| Example No. | Spinning method | Denier (dtex) | Carboxyl group content of the polymer % | Knot strength (cN/tex) | Water retention % |
|---|---|---|---|---|---|
| 1 | wet | 3.2 | 25.4 | 11 | 57 |
| 2 | wet | 3.3 | 18.4 | 9 | 37 |
| 3 | wet | 3.4 | 15.4 | 9 | 33 |
| 4 | dry | 3.2 | 15.4 | 10 | 29 |

In order to determine the carboxyl group content, about 150 mg of the polymer were dissolved in 25 ml of dimethyl sulfoxide (DMSO), 60 ml of water were added and a potentiometric titration was carried out using 0.1N sodium hydroxide solution. The caustic soda factor was determined with oxalic acid, which had been dissolved in 60 ml of water to which 25 ml of DMSO had been added.

In order to determine the water retention, in each case about 500 mg, or lower amounts in the case of high retention values, of cut filaments were placed in a round beaker made of polytetrafluoroethylene, the open bottom of which had been fitted with a fine-mesh gauze of V4A stainless steel. The inner diameter of the beaker was 1.8 cm and the height, measured from the gauze was 3.9 cm. The beakers with their contents were kept for 1 hour in deionized water, 1 g per liter of the sodium salt of diisobutylnaphthalenesulfonic acid having been added to the water as wetting agent. At the beginning of the liquid treatment the samples were subjected to vacuum for 5 minutes in order to remove adhering air bubbles. After the treatment period, during which the samples, if appropriate, had also been swirled about in the liquid, the centrifugation proper was carried out by means of a laboratory centrifuge made by Messrs. Heraeus Christ GmbH, model UJO. The containers and samples were in each case centrifuged for 30 minutes at 4,000 rpm. The distance of the gauzes in the beakers from the axis of the centrifuge was in each case 8.5 cm. Subsequently, the centrifuged fiber samples were weighed and then dried to constant weight in a drying cabinet at 120° C. The weight difference between the moist and the dried sample, divided by the dry weight, was recorded, in percent, as the water retention.

The staple fiber samples so produced were then processed into card slivers and were stored overnight in this form in glass containers which had been filled with gaseous ammonia.

The water retention, the tensile strength and the knot strength were determined on the fiber samples. The values obtained have been collated in the table below.

| Example No. | Tensile strength cN/tex | Knot strength cN/tex | Water retension % |
|---|---|---|---|
| 1 | 12 | 9 | 2,693 |
| 2 | 17 | 9 | 610 |
| 3 | 18 | 9 | 397 |
| 4 | 16 | 10 | 331 |

The fibers obtained in the 4 examples were not stuck together; the card slivers could be processed into yarns without difficulties.

EXAMPLE 5

A yarn of 300 filaments each of 2.9 dtex, the filament-forming substance of which was composed of a polymer with a carboxyl group content of 17.8%, was treated with ammonia gas at atmospheric pressure. At specified time intervals, samples were removed and the water retention determined. The following results were measured:

| | | |
|---|---|---|
| after | 1 minute | 90% water retention |
| after | 5 minutes | 125% water retention |
| after | 30 minutes | 350% water retention |
| after | 60 minutes | 430% water retention |
| after | 300 minutes | 670% water retention |

I claim:

1. A method for making a fiber or filament of a swellable polymer of high tensile strength, which method consists essentially of reacting a fiber or filament of an untreated copolymer of acrylonitrile containing about 10 to 30 percent by weight of carboxyl groups with a base in the absence of water to convert said carboxyl groups at least partially into a corresponding salt form.

2. A swellable fiber or filament made by the method of claim 1.

3. A swellable fiber or filament as in claim 1 having a knot strength of at least 8 cN/tex.

4. A method as in claim 1 wherein said base is a compound having at least one nitrogen atom.

5. A method as in claim 1 wherein said base is reacted in the gaseous state with said carboxyl groups.

6. A method as in claim 1 wherein said base is ammonia, hydrazine, or an organic compound vaporizing below 200° C. and selected from the group consisting of amines, heterocyclic nitrogen compounds, and hydrazines.

7. A swellable filament or fiber made by the method of claim 1 and exhibiting in the dry state, a tensile strength above 10 cN/tex and a knot strength above 6 cN/tex whereby said filaments or fibers are suitable for processing into waddings, yarns and sheet structures.

8. The filament or fiber of claim 1 wherein the knot strength is at least 8 cN/tex.

* * * * *